US005558212A

United States Patent [19]

Sutherland

[11] Patent Number: 5,558,212

[45] Date of Patent: Sep. 24, 1996

[54] WRAP-AROUND CARRIER WITH BAR CODE BLOCKER

[75] Inventor: Robert L. Sutherland, Kennesaw, Ga.

[73] Assignee: Riverwood International Corporation, Atlanta, Ga.

[21] Appl. No.: 335,930

[22] Filed: Nov. 8, 1994

[51] Int. Cl.[6] ..... B65D 75/00

[52] U.S. Cl. ..... 206/147; 206/427

[58] Field of Search ..... 206/139, 140, 206/141, 145, 147, 427, 434

[56] References Cited

U.S. PATENT DOCUMENTS 5,000,313 3/1991 Oliff ..... 206/427 X
5,060,792 10/1991 Oliff ..... 206/434 X
5,311,984 5/1994 Harris ..... 206/427 X
5,360,104 11/1994 Sutherland ..... 206/147

*Primary Examiner*—Jacob K. Ackun

[57] ABSTRACT

A wrap-around carrier including partial end panels extending up from the bottom panel for covering the pricing code on the end articles in the package. The partial end panels are comprised of flaps connected to the bottom panel flaps. Angle panels connected to the bottom panel flaps and adjacent side panel locking flaps contact the bottom portions of the articles while portions of the side panel locking flaps are engaged by the articles to hold the locking flaps in place, which in turn holds the end panel flaps in place.

7 Claims, 3 Drawing Sheets

WRAP-AROUND CARRIER WITH BAR CODE BLOCKER

FIELD OF THE INVENTION

This invention relates to wrap-around article carriers. More particularly, it relates to wrap-around carriers which include partial end panels capable of blocking the pricing code printed on the end articles in the carrier.

BACKGROUND OF THE INVENTION

Certain types of articles, such as food or beverage containers, are commonly sold either as individual units or in a multi-container carton. Each article is normally marked with a bar pricing code to enable it to be scanned and automatically totaled at a retail outlet when sold as an individual item. When packaged in conventional open-ended wrap-around carriers, pricing errors can occur if the scanner sees the pricing code on one of the articles instead of the code on the package itself. One way to prevent this from happening is to package the articles in a completely enclosed carton or carrier. An enclosed carrier is quite expensive, however, compared to a wrap-around carrier due to the greater amount of stock required.

It is preferred to provide wrap-around carriers with partial end panels of a size sufficient to cover the pricing code on the end articles in the package. Such a design would require less stock than a fully enclosed carrier and be correspondingly more economical to produce. Partial end panels designed to cover pricing codes located near the bottom of the article require only a short panel extending up from the bottom panel. Ideally, the short end panels should be large enough to cover the pricing code of the end articles, should not interfere with the normal fabrication and packaging methods of wrap-around carriers and should be locked in place after being formed.

The main object of the invention, therefore, is to provide an improved partial end panel design having all the desirable features mentioned above while maintaining the cost of the end panels at a minimum.

BRIEF SUMMARY OF THE INVENTION

The invention comprises a wrap-around carrier having partial end panels formed of end panel flaps foldably connected to the bottom panel flaps of the carrier. Side panel locking flaps are connected to the end edges of the side panels of the carrier and angle panels are foldably connected to, and located between, the end panel flaps and associated side panel locking flaps. Each angle panel contacts an outer bottom portion of an adjacent packaged article and each side panel locking flap is in substantial face-to-face engagement with an adjacent portion of the associated side panel. A portion of each side panel locking flap is in contact with an associated article to thereby hold the angle panels and the end panel flaps in place. The end panel flaps, which extend up a sufficient distance to cover the pricing code of the end articles, overlap each other and do not require additional means, such as glue, to hold them in place.

In a preferred arrangement the fold lines connecting the side panel locking flaps to the side panels form a slightly obtuse angle with the fold lines connecting the bottom panel flaps to the side panels. This arrangement enables the folding of the side panel locking flaps to automatically fold the angle panels and the end panel flaps into place.

The above and other aspects and benefits of the invention will readily be apparent from the more detailed description of the preferred embodiment of the invention which follows.

DETAILED DESCRIPTION OF THE PREFERRED EMBODIMENT

Figure 1:
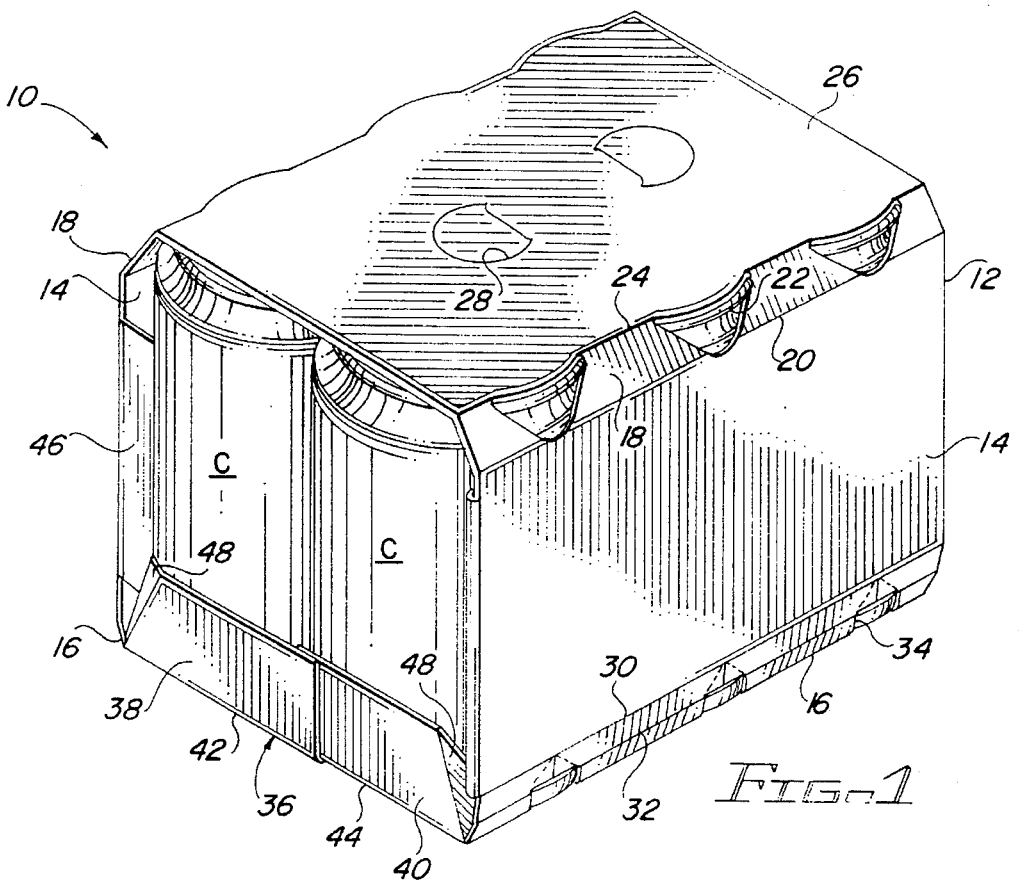
FIG. 1 is a pictorial view of the wrap-around carrier of the invention illustrated as part of a package containing six beverage cans.
Figure 2:
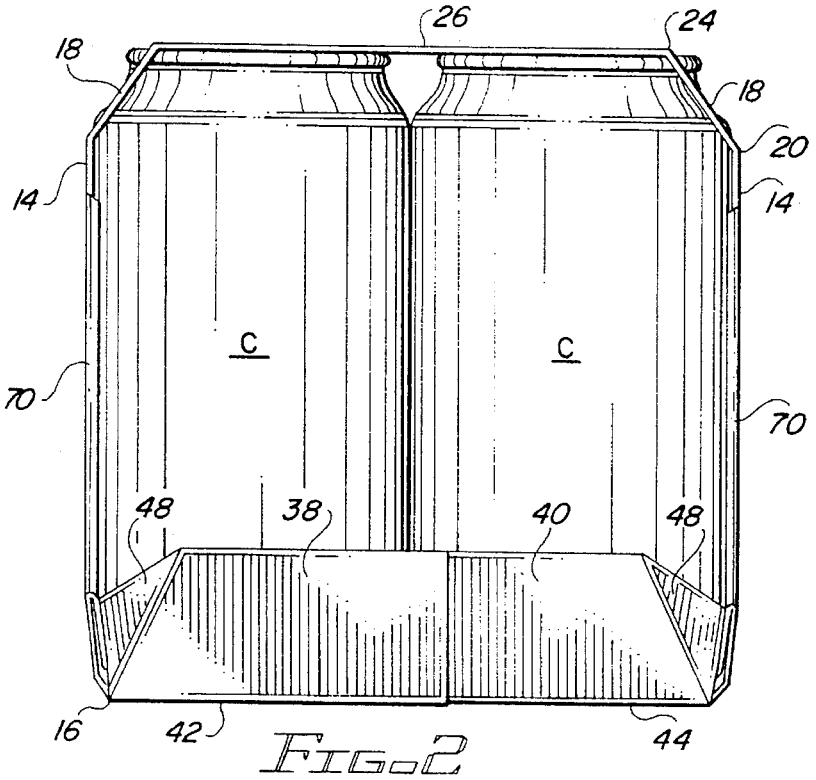
FIG. 2 is an end view of the carrier of FIG. 1.

Referring to FIGS. 1 and 2, a package 10 is comprised of a wrap-around carrier 12 containing six abutting beverage cans C, arranged in two rows of three cans each, supported on a bottom panel, not visible in these views. Side panels 14 are connected to the bottom panel along fold lines 16 and to short sloped shoulder panels 18 along fold lines 20. The sloped panels 18, which contain cutouts 22 through which the can chimes may protrude, permit the upper portions of the side panels to more closely conform to the tapered upper portions of the cans and are connected by fold lines 24 to top panel 26. The top panel includes finger holes 28 to facilitate lifting the carrier. In addition, the lower portion of the side panels includes score lines 30 and 32 which allow the wrapper to be pulled tightly about the bottom portion of the cans. Cutouts 34 are provided in the section between the fold lines 16 and 32 into which the bottom portions of the cans may extend to facilitate the step of tightly wrapping the carrier about the cans. The carrier also includes partial end panels 36 comprised of overlapping end panel flaps 38 and 40 connected to the bottom panel along fold lines 42 and 44. The end panel flaps 38 and 40 are connected to side panel locking flaps 46 by means of angle panels 48. As explained in more detail below, the side panel locking flaps and the angle panels cause the end panels to be formed and they subsequently maintain the end flaps in place.

Figure 3:
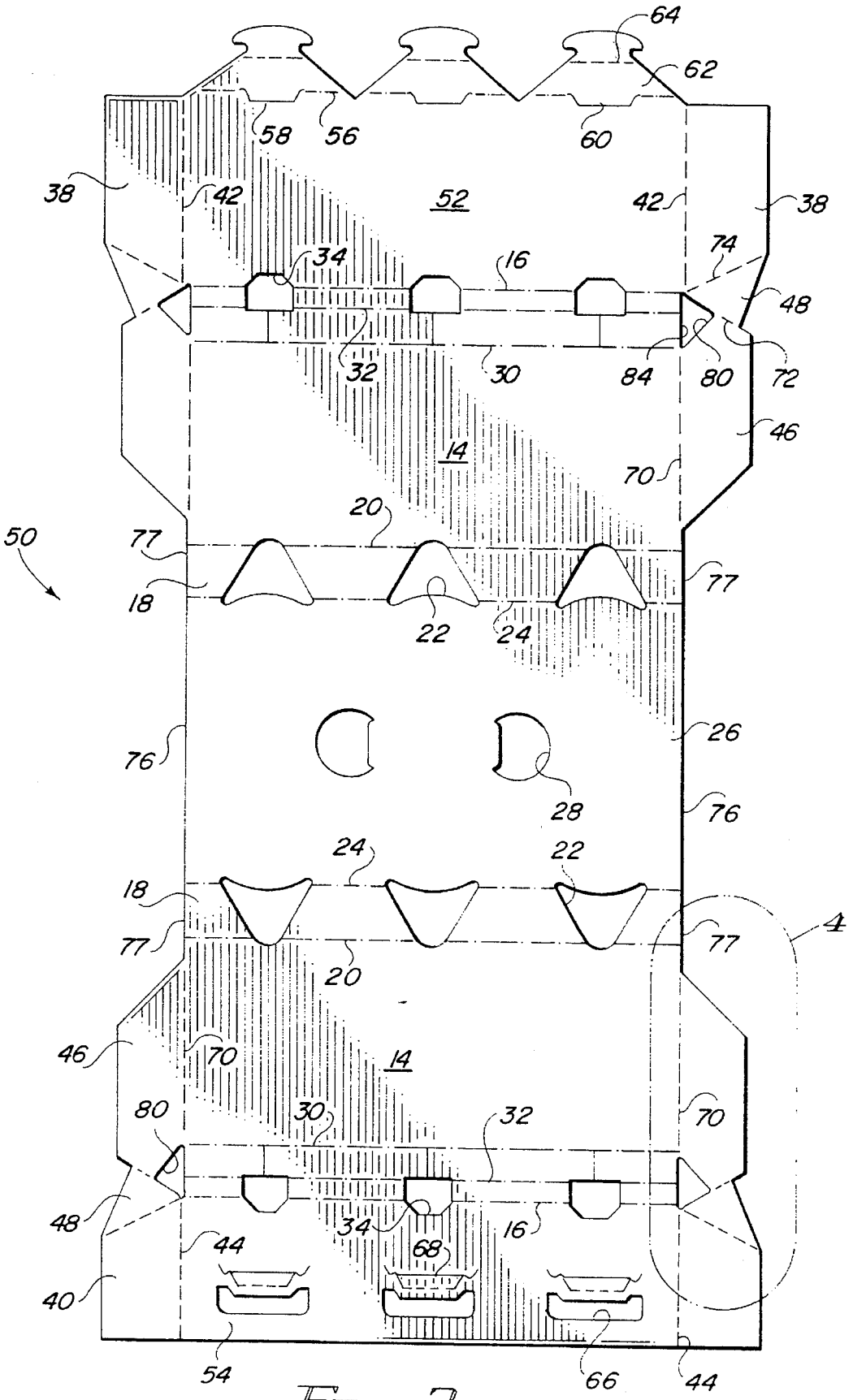
FIG. 3 is a plan view of a blank for forming the carrier of FIG. 1.
Figure 4:
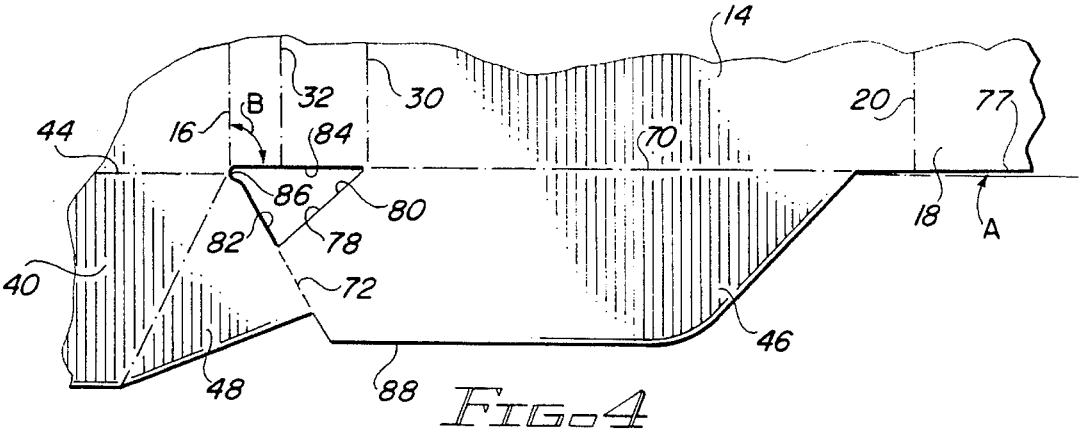
FIG. 4 is an enlarged plan view of the area within the oval 4 of FIG. 3.

Referring to FIGS. 3 and 4, wherein like reference numerals to those used in FIGS. 1 and 2 denote like elements, a generally rectangular blank 50 capable of being fabricated into the carrier of FIG. 1 includes a centrally located top panel section 26, adjacent short shoulder panel sections 18 connected by the fold lines 24 and side panel sections 14 connected to the short panel sections 18 by the fold lines 20. Connected to the side panel sections at the fold lines 16 at opposite ends of the blank are bottom panel flaps 52 and 54. The bottom panel flap 52, which is the outer bottom panel flap, includes a fold line 56 which is interrupted by slits 58 forming primary male locking tabs 60. Secondary male locking tabs 62 are connected along the fold line 56 and include an intermediate fold line 64. The bottom panel flap 54, which is the inner bottom panel flap, incorporates cutouts including primary female locking edges 66 adapted to engage the primary male locking tabs 60. The flap 54 also includes slits 68 adapted to receive the outer portions of the secondary locking tabs 62. Although these various locking elements are illustrated to demonstrate a typical bottom panel locking arrangement suitable for use with the carrier of the invention, it should be understood that any desired effective form of bottom panel locking means may be employed.

Still referring to FIGS. 3 and 4, the side panel locking flaps 46 are connected to the side panel sections 14 by fold lines 70, which terminate at the ends of the score lines 30. The angle panels 48 are connected to the side panel locking flaps 46 and the end panel flaps 38 and 40 by angled fold lines 72 and 74, respectively. Fold lines 42 and 44, which connect the end panel flaps to the bottom panel flaps, are substantially parallel to and aligned with the end edges 76 of the top panel section 26 and the end edges 77 of the shoulder panels 18. The fold line 70, however, is angled slightly inwardly for a reason explained below. This is best illustrated in FIG. 4 by the angle A formed by the edge 77 and an extension of the fold line 70. A cutout 78 is formed between adjacent side panel locking flaps and gusset panels by the edge 80 of the side panel locking flap, the edge 82 of the angle panel 48 and the edge 84 of the lower portion of the side panel section 14. The edge 84 is a continuation of the angled fold line 70, and so terminates slightly inwardly of the fold lines 42 and 44. The outer end of the edge 84 is connected to the edge 82 of the cutout by a short arcuate edge 86, which also intersects the fold lines 42 and 44. Note that the fold line 72 terminates short of the outer edge 88 of the side panel locking flap 46.

Figure 5:
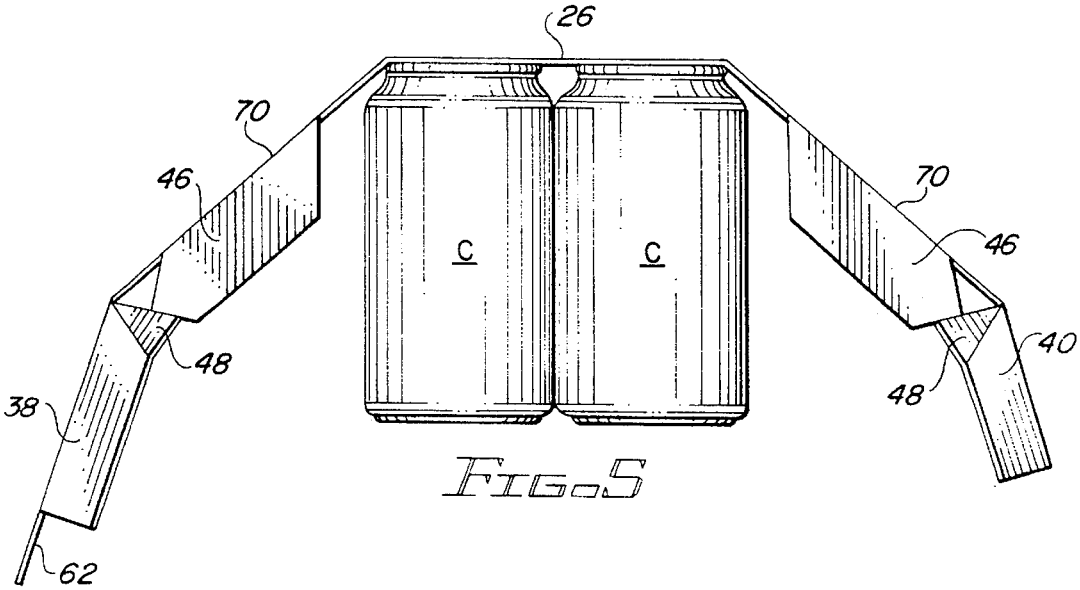
FIG. 5 is an end view of an initial stage of the carrier blank as it is being wrapped around a group of cans during formation of a carrier.

To form the package of FIG. 1, a blank is moved onto a group of six cans and the side panel sections 14 are folded about the fold lines 24 so that the can chimes extend into the cutouts 22. The bottom panel flaps 52 and 54 are then folded in along their fold lines 16 while at the same time pivoting the side panel locking flaps 46 in about the fold lines 70. Inward movement of the side panel locking flaps moves the fold line 72 inwardly, which pulls the angle panel 48 inwardly, folding up about the fold line 74. FIG. 5 illustrates the carrier at a representative point during this initial stage of fabrication.

Figure 6:
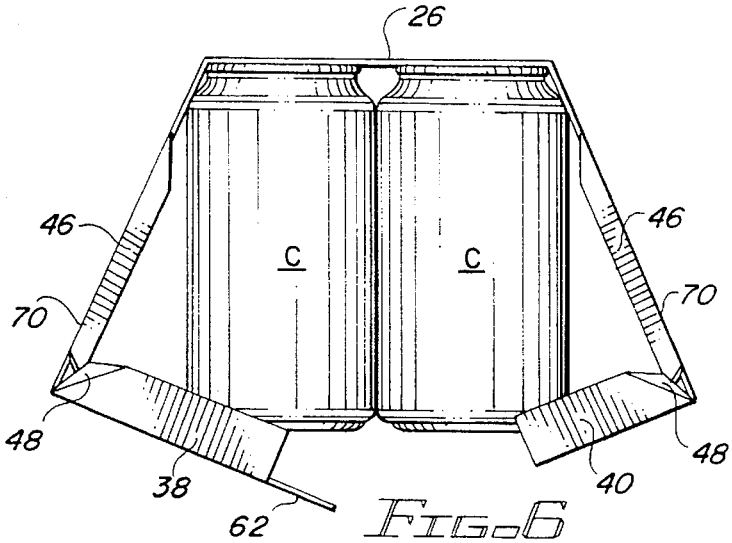
FIG. 6 is an end view similar to that of FIG. 5, but showing the carrier in a later stage of formation.

As the folding of the side panel sections, the bottom panel flaps and the side panel locking flaps continues, the side panel locking flaps move toward their final position in which they lie substantially flat against the connected side panel, while movement of the angle panels cause the end panel flaps to pivot to a position substantially at right angles to the connected bottom panel flap. The position of these elements just prior to arriving at their final positions is illustrated in FIG. 6. The angle panels have been formed to fit around the outer bottom portions of the cans when in their final position. The outer portions of the side panel locking flaps 46 which extend beyond the ends of the fold lines 72 are located so as to be pinched between the adjacent can and the adjacent side panel, thereby locking the side panel locking flaps in place. With the side panel locking flaps held against movement, the end panel flaps are held in their final vertical position and the angle panels are maintained in fixed position, assisting to hold the end cans against outward movement. This can best be seen by referring back to the end view of FIG. 6.

Referring back now to FIGS. 3 and 4, note that the fold line 70 forms a slight angle with the end edge of the top panel which is indicated in FIG. 4 as angle A. This causes the fold line 70 to form a slightly obtuse angle with the fold line 16, as indicated in FIG. 4 by the angle B. The purpose of having the fold line 70 angle in slightly is to cause the fold line 72 to move well into the interior of the carrier as the side panel locking flap 46 is pivoted into place, thereby causing the angle panels and end panel flaps to fold into their desired positions. This will not occur satisfactorily if the fold line 70 is angled outwardly and will not function as well even if it is an extension of the edge of the top panel. The cutout 80 serves to eliminate material which would otherwise bunch together and interfere with the folding of the adjacent elements. It also shortens the fold line 72, thereby reducing the pulling force necessary to cause the angle panels to fold about the fold lines 72.

Even though the partial end panels formed by the invention are comprised of overlapping flaps, the mechanism described above holds each end panel flap in its final vertical position which combine to form an end panel without the need for gluing. The height of the end panel flaps is sufficient to cover the bar pricing code on the end cans.

While these folding steps can be done by hand it is contemplated that they would be carried out in a packaging machine as the cans and blank are continuously moving through the machine. Although the carrier has been described in connection with the packaging of beverage cans, it is clear that the invention may be utilized in connection with the packaging of other types of articles as well. After the end panel forming procedures are completed the bottom panel is formed by folding in the bottom panel flaps and locking them together. The details of the locking phase of the operation have not been illustrated since the particular locking mechanism employed does not form part of the invention. It will be understood by those familiar with the locking elements shown, however, that the locking tabs 62 are first folded back about the fold lines 56 and the primary male locking tabs 60 are then engaged with the primary female locking edges 60 in bottom panel flap 54. The outer portions of the secondary male locking tabs 62 are then inserted through the slits 68 to complete the mechanical locking action.

Although the formation of a carrier has been described in connection with a procedure in which the cans are upright and the blank is positioned on top of the cans, it will be appreciated that the cans may instead be inverted and moved onto a blank.

It should now be apparent that the invention provides a means for covering the pricing code of end articles in a wrap-around carrier by automatically locking partial end panel flaps in place when the end panels are formed. It will be understood, however, that the invention is not limited to all the specific details described in connection with the preferred embodiment and that changes to certain features of the preferred embodiment which do not alter the overall basic function and concept of the invention may be made without departing from the spirit and scope of the invention defined in the appended claims.

What is claimed is:

1. A package comprised of a wrap-around carrier containing two rows of adjacent articles, comprising:

opposite side panels connected to top and bottom panels, the bottom panels being comprised of overlapping bottom panel flaps and the side panels and bottom panel flaps including end edges;

an end panel flap connected to each end edge of the bottom panel flaps along a first fold line, associated end panel flaps being in overlapping relationship to each other and extending at substantially right angles to the bottom panel flaps;

a side panel locking flap connected to each end edge of the side panels along a second fold line;

an angle panel located between each end panel flap and an associated side panel locking flap, the angle panel being connected along a third fold line to the end panel flap and along a fourth fold line to the side panel locking flap, the fourth fold line being relatively short compared to the third fold line;

each angle panel being adjacent an article and contacting an outer bottom portion thereof;

each side panel locking flap being in substantial face-to-face engagement with an adjacent portion of the associated side panel; and a portion of each side panel locking flap extending a substantial distance beyond the fourth fold line, said portion being in contact with an associated article, whereby the locking panels are held in place by said contact.

2. A package according to claim 1, wherein adjacent portions of associated side panel locking flaps and end panel flaps are separated by a cutout extending outwardly from the fourth fold line.

3. A blank for forming a wrap-around carrier for packaging two rows of adjacent articles, comprising:

a sheet of generally rectangular shape including a centrally located top panel section;

opposite side panel sections connected to the top panel section by fold lines and a bottom panel flap connected to each side panel section by a fold line, the side panel sections and the bottom panel flaps including end edges;

an end panel flap connected to each end edge of the bottom panel flaps along a first fold line;

a side panel locking flap connected to each end edge of the side panel sections along a second fold line; and an angle panel located between each end panel flap and an associated side panel locking flap, the angle panel being connected along a third fold line to the end panel flap and along a fourth fold line to the side panel locking flap, the fourth fold line being relatively short compared to the third fold line and each side panel locking flap including a portion extending outwardly of the fourth fold line;

each side panel locking flap being in substantial face-to-face engagement with an adjacent portion of the associated side panel in a carrier formed from the blank.

4. A carrier blank according to claim 3, wherein adjacent portions of associated side panel locking flaps and end panel flaps are separated by a cutout extending inwardly from the fourth fold line.

5. A package comprised of a wrap-around carrier containing two rows of adjacent articles, comprising:

opposite side panels connected to top and bottom panels, the bottom panels being comprised of overlapping bottom panel flaps and the side panels and bottom panel flaps including end edges;

an end panel flap connected to each end edge of the bottom panel flaps along a first fold line;

a side panel locking flap connected to each end edge of the side panels along a second fold line;

an angle panel located between each end panel flap and an associated side panel locking flap, the angle panel being connected along a third fold line to the end panel flap and along a fourth fold line to the side panel locking flap;

each angle panel being adjacent an article and contacting an outer bottom portion thereof;

each side panel locking flap being in substantial face-to-face engagement with an adjacent portion of the associated side panel;

a portion of each side panel locking flap being in contact with an associated article, whereby the locking panels are held in place by said contact; and each bottom panel flap being connected to an associated side panel along a fifth fold line, the first fold line of each bottom panel flap forming substantially a right angle with the fifth fold line and the second fold line of each associated side panel locking flap forming a slightly obtuse angle with the fifth fold line.

6. A package according to claim 5, wherein the end edge of each side panel intersects the fifth fold line at a point inwardly spaced from the first fold line.

7. A blank for forming a wrap-around carrier for packaging two rows of adjacent articles, comprising:

a sheet of generally rectangular shape including a centrally located top panel section;

opposite side panel sections connected to the top panel section by fold lines and a bottom panel flap connected to each side panel section by a fold line, the side panel sections and the bottom panel flaps including end edges;

an end panel flap connected to each end edge of the bottom panel flaps along a first fold line;

a side panel locking flap connected to each end edge of the side panel sections along a second fold line;

an angle panel located between each end panel flap and an associated side panel locking flap, the angle panel being connected along a third fold line to the end panel flap and along a fourth fold line to the side panel locking flap;

each side panel locking flap being in substantial face-to-face engagement with an adjacent portion of the associated side panel in a carrier formed from the blank; and each bottom panel flap being connected to an associated side panel along a fifth fold line, the first fold line of each bottom panel flap forming substantially a right angle with the fifth fold line and the second fold line of each associated side panel locking flap forming a slightly obtuse angle with the fifth fold line.

* * * * *